United States Patent [19]

Irwin

[11] Patent Number: 4,487,579

[45] Date of Patent: Dec. 11, 1984

[54] SUPERSTRUCTURE FOR KILN CAR

[75] Inventor: David M. Irwin, East Liverpool, Ohio

[73] Assignee: The Potters Supply Company, East Liverpool, Ohio

[21] Appl. No.: 558,261

[22] Filed: Dec. 5, 1983

[51] Int. Cl.[3] ..... F27D 3/12; F27D 5/00; F27B 9/26

[52] U.S. Cl. ..... 432/241; 432/137; 432/253

[58] Field of Search ..... 432/241, 137, 253

[56] References Cited

U.S. PATENT DOCUMENTS

| | | | |
|---|---|---|---|
| 954,029 | 4/1910 | Jester | 432/58 |
| 1,665,631 | 4/1928 | Laschenski | 432/241 |
| 1,908,186 | 5/1933 | Robertson | 432/253 |
| 1,969,126 | 8/1934 | Forse | 432/258 |
| 2,118,641 | 5/1938 | Diamond | 432/241 |
| 2,300,783 | 11/1942 | Grubel et al. | 432/253 |
| 2,537,145 | 1/1951 | Lovatt et al. | 432/253 |
| 2,629,917 | 3/1953 | Lovatt | 432/253 |
| 2,871,543 | 2/1959 | Easter | 432/258 |
| 2,879,577 | 3/1959 | Milburn | 432/258 |
| 2,969,969 | 1/1961 | Gummeson | 432/253 X |
| 4,315,738 | 2/1982 | Lovatt | 432/258 |
| 4,407,654 | 10/1983 | Irwin | 432/258 |

*Primary Examiner*—John J. Camby

*Attorney, Agent, or Firm*—Biebel, French & Nauman

[57] ABSTRACT

A kiln car superstructure is formed by inserting horizontal tying members into openings in hollow vertical support posts and interlocking the tying members within the posts. Two tying members are inserted into opposite openings in each post with each member extending to approximately the post center. Apertures through the tying members are located within the post interior when the tying members are positioned to form the superstructure. Locking pins are inserted into the apertures in the tying members and wedges are then inserted between the ends of the tying members. The wedges force the tying members apart which in turn force the locking pins against the interior of the post. The posts comprise sections which are stably stacked by means of post couplers having a center section sized to conform to the exterior of the post sections with reduced extensions on either side to enter the hollow interiors of the post sections. Article supporting shelves are themselves supported upon selected ones of the tying members with the article supporting shelves being formed in two sections having overlapping joints.

20 Claims, 7 Drawing Figures

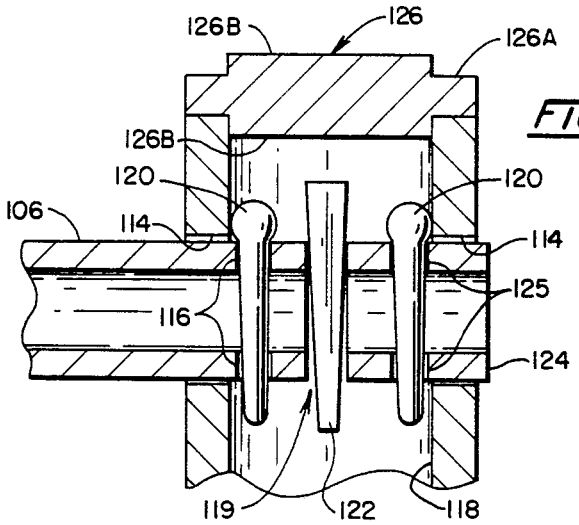
FIG. 5
FIG. 6
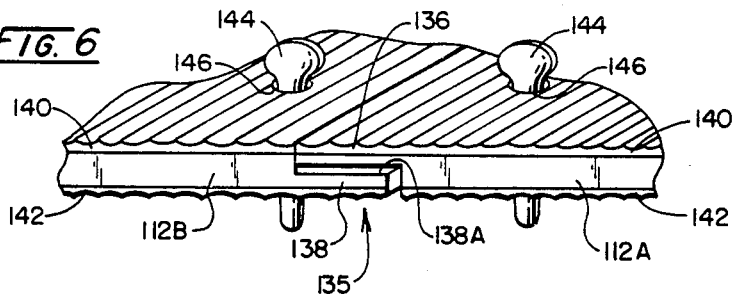
FIG. 7
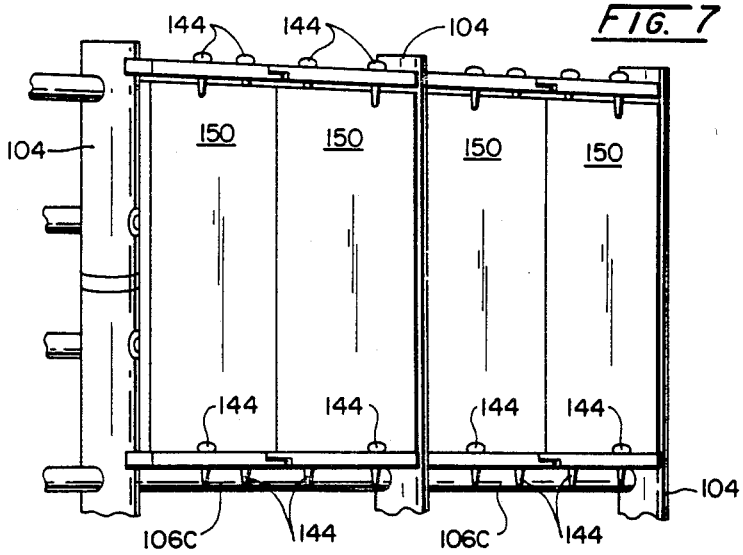

SUPERSTRUCTURE FOR KILN CAR

BACKGROUND OF THE INVENTION

This invention relates generally to apparatus for supporting ceramic articles to be kiln fired and, more particularly, to improvements in a superstructure for a kiln car used to support and convey articles to be kiln fired.

A variety of ceramic article supporting superstructures are known in the prior art. The most common superstructures use large slabs supported on pillars or posts with the upper surfaces of the slabs serving as the article supporting surfaces.

The usual method of constructing such a kiln car superstructure is to place a slab on top of four vertical pillars positioned such that the slab is supported at its corners. By placing four more vertical pillars on top of the first slab substantially in line with the first four pillars, a second slab is supported thereabove. By repeating this process, a desired number of ware supporting surfaces or decks are constructed on the kiln car.

Slabs may be supported and joined across their width and length to form a superstructure that matches the dimensions of a particular user's kiln car. This stacked type of kiln car superstructure is disclosed, for example, in U.S. Pat. No. 1,665,631 and U.S. Pat. No. 2,879,577. Even though the slabs are oftentimes cemented to the posts, stacked superstructures tend to lack mechanical stability and rigidity. The concentration of the accumulated weight of the upper shelves and pillars at the corners of the lower shelves coupled with thermal stresses encountered during kiln firing also tends to cause cracking in this area of the lower shelves. Further, if a shelf must be removed for any reason, e.g., cracked corners, it is necessary to tear down the shelves and pillars above the one to be removed, frequently leading to the disassembly of the entire structure.

To improve the superstructure formed by stacked pillars and slabs, a unitary pillar or post provided with projections along the post at locations. where shelves are to be supported is disclosed in U.S. Pat. No. 1,969,126. This unitary post construction does eliminate the concentration of the accumulated weight of the upper posts and shelves at the corners of the lower shelves as found in the stacked arrangement. However, the unitary posts are not readily adaptable to the construction of varying height superstructures and the shelves are still supported only at the corners. Also, even though the unitary posts are pinned at a top-most shelf or cover, the resulting structure is not as stable or rigid as desirable for a kiln car superstructure.

It is, thus, apparent that a need exists for an improved superstructure for a kiln car which provides versatility, stability and rigidity for supporting articles and article carriers during kiln firing.

SUMMARY OF THE INVENTION

The shortcomings of the prior art are overcome in accordance with the present invention by a kiln car superstructure wherein horizontal tying members are used to interconnect hollow vertical support posts. The horizontal tying members are interlocked within the hollow interior of the vertical support posts to thereby stabilize and rigidify the kiln car superstructure. Article shelves are supported upon selected ones of the horizontal tying members and are formed to engage the vertical support posts to thereby stabilize the shelves.

Openings are formed through the walls of the hollow vertical support posts to receive the horizontal tying members. Two tying members are inserted into two opposite post openings and extend to approximately the center of the hollow interior of the vertical support posts. The ends of the two members are adjacent to one another within the vertical support posts, but are separated by a small gap when positioned to form the superstructure. The horizontal tying members include apertures formed therethrough and located relative to the ends of the members such that the apertures are within the hollow vertical support posts approximately adjacent to the interior wall thereof when positioned to form the superstructure.

Locking pins are inserted into the apertures formed in the horizontal tying members to prevent them from being withdrawn from the vertical support posts. Wedges are then inserted into the gaps between the inserted ends of the horizontal tying members with the wedges tending to enlarge the gaps and force the locking pins against the interior of the hollow vertical support posts to thereby stabilize and rigidify the kiln car superstructure.

For versatility in the kiln car superstructure of the present invention, the vertical support posts comprise sections of one or more selected lengths which are stably stacked one upon the other by means of posts couplers. The post couplers have an outer geometric form the same as the vertical post sections with projections on either side which correspond to the hollow interior geometry of the vertical post sections. In this way, varying height superstructures can be constructed by coupling selected lengths of post sections together. Preferably, the horizontal tying members are hollow to reduce the weight of the superstructure and, hence, the energy required to fire articles supported on the superstructure.

In the illustrated embodiment of the present invention, the shelves of the kiln car superstructure have at least the upper edges beveled to reduce the potential for engagement of articles (or article carrying structures) with the upper edges of the shelves as articles (or article carrying structures) are slid across the shelves. The shelves are preferably formed in at least two sections having overlapping joints whereby dirt is prevented from falling onto articles supported beneath the shelves. The lower edges of the shelves may also be beveled such that the shelves are reversible, top for bottom, for use in the superstructure.

Contact between sections of a shelf may result in the generation of dust or dirt which could fall beneath the shelf. It may, therefore, be desirable to form the overlap such that the shelves only contact at the end of the overlapping upper extension or lip with space provided between the overlapping extensions and between the lower extension or lip and its adjacent shelf section. With contact thus limited to the upper extension or lip and its adjacent shelf section, any dust which is formed by the contact accumulates on the lower lip or shelf-like extension of the lower overlapping joint and is not permitted to fall upon articles beneath the shelf. Such shelves are not reversible since contact between reversed shelf sections would be on the bottom of the shelf and any dust generated would not then be retained by the overlapping joint.

The shelves are preferably sized in relation to the remainder of the superstructure such that circulation gaps are formed between adjacent shelves with wedges being inserted into the circulation gaps for maintaining the gaps and to further rigidify and stabilize the superstructure by forcing the shelves into the vertical support posts. The shelves also preferably include apertures for receiving baffle retaining pins which, in cooperation with the vertical support posts, retain baffle plates on the sides of the superstructure to protect articles from direct kiln heat.

It is, therefore, an object of the present invention to provide an inexpensive, lightweight superstructure for a kiln car which is stable and substantially rigid for supporting articles to be subjected to a firing process upon the kiln car.

It is another object of the present invention to provide a lightweight, interlocking kiln car superstructure for supporting articles to be subjected to a firing process on the kiln car wherein a variety of the components forming the superstructure can be interchanged with one another to provide versatility in constructing kiln car superstructure and allow economical replacement of damaged components of the superstructure.

It is yet another object of the present invention to provide a kiln car superstructure wherein horizontally extending members are interlocked within hollow vertical support posts by means of locking pins inserted through apertures formed through the horizontal members and located within the interiors of the vertical support posts upon construction of the superstructure with wedges being inserted between the horizontal members to force the locking pins to engage the interior surfaces of the hollow vertical support posts to thereby stabilize and rigidify the superstructure.

Other objects and advantages of the invention will be apparent from the following description, the accompanying drawings and the appended claims.

BRIEF DESCRIPTION OF THE DRAWINGS

FIGS. 4 and 5 are cross-sectional views through vertical support posts of FIG. 3 taken along the lines 4—4 and 5—5, respectively, to show the interlocking post arrangement in accordance with the present invention.

FIG. 6 is a perspective view showing an overlapped joint between two shelf sections.

FIG. 7 is a perspective view showing baffle plates positioned on the superstructure in accordance with the present invention.

DETAILED DESCRIPTION OF THE INVENTION

Figure 1:
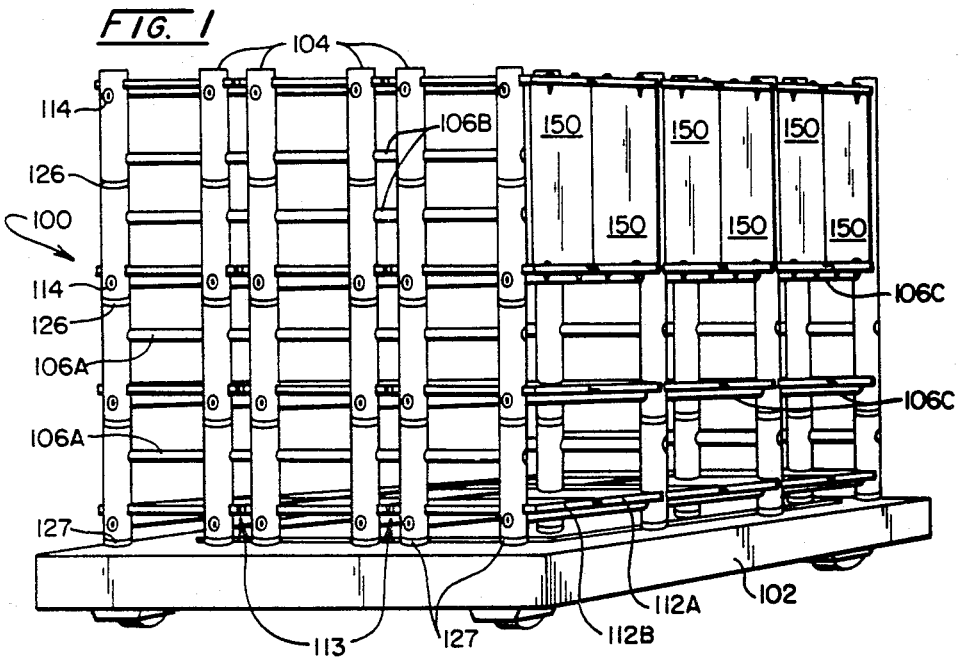
FIG. 1 is a perspective view of a kiln car incorporating a superstructure in accordance with the present invention.
Figure 2:
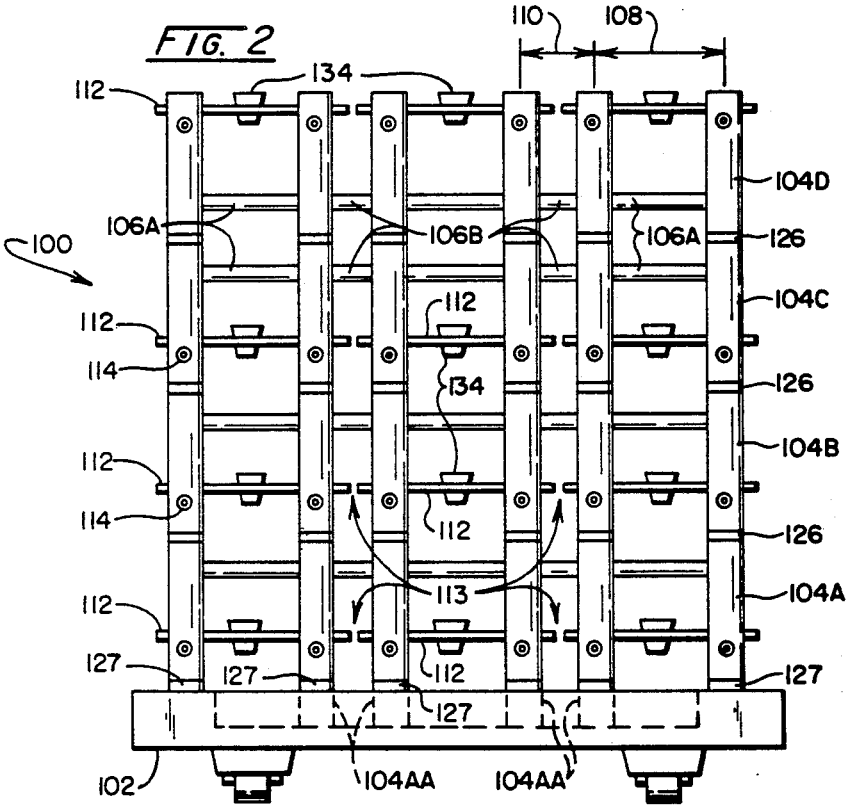
FIG. 2 is a front view of the kiln car superstructure of FIG. 1.
Figure 3:
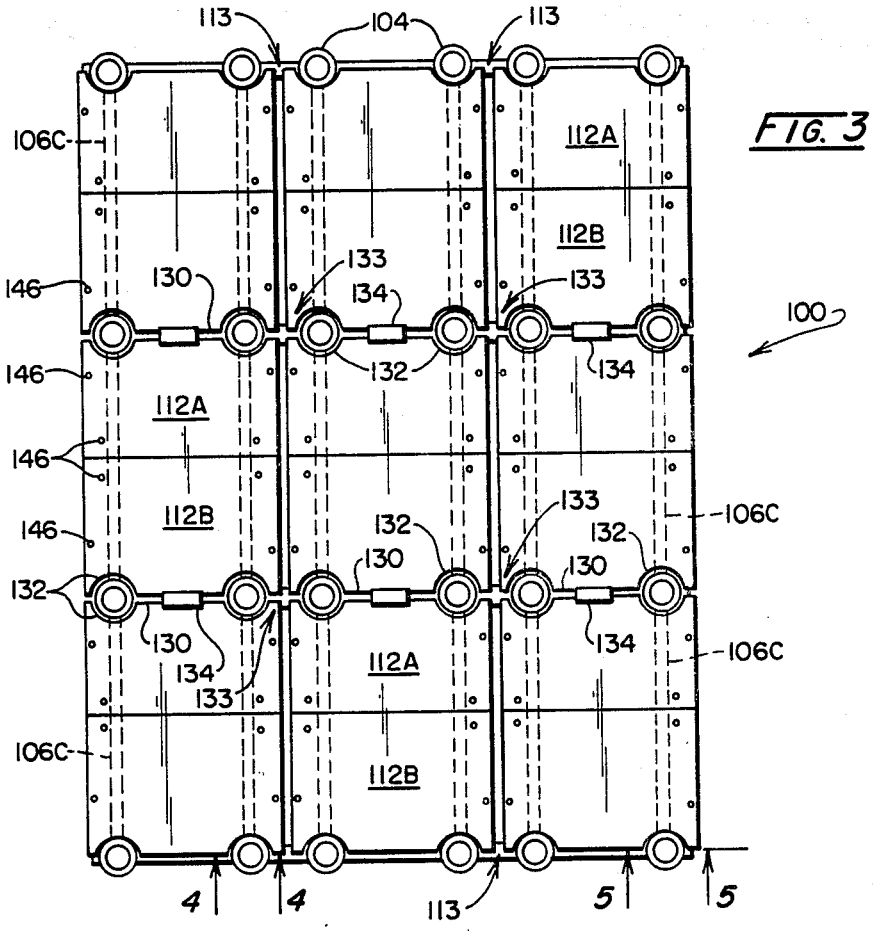
FIG. 3 is a top view of the kiln car superstructure of FIG. 1.

With reference to FIGS. 1-3, a superstructure 100 in accordance with the present invention is shown assembled on a kiln car 102. The superstructure 100 comprises hollow vertical support means or posts 104 which provide vertical support for the superstructure. The vertical support posts 104 are interconnected or tied by horizontal tying means or members 106 which extend between adjacent vertical posts 104 and are preferably hollow.

The superstructure 100 as shown in FIGS. 1-3 includes tying members 106A, 106B of first and second dimensions 108 and 110. The larger of the two dimensions 108 provides the proper spacing between vertical support posts 104 for receiving article supporting shelf means or shelves 112 which each comprise two shelf sections 112A and 112B, as will be more clearly defined hereinafter. The smaller of the two dimensions 110 ensures the formation of circulation gaps 113 between longitudinally adjacent shelves 112.

The sides of the superstructure 100 as shown in FIG. 1 have horizontal tying members 106C which are of a third dimension. The horizontal tying members 106C also serve as horizontal supports for the article receiving shelves 112. As is illustrated, the horizontal tying members 106C provide support along the entire length of the shelves 112 with at least two typing members 106C supporting each shelf. The improved shelf support of the tying members 106C permits lighter weight, less massive shelves to be used in the superstructure.

The combination tying and supporting members 106C are spaced to define entry openings for inserting articles or article carriers such as those illustrated in U.S. Pat. No. 4,407,654 into the superstructure 100. Hence, in the illustrated embodiment of FIG. 1, the dimensions of the members 106C exceed the dimensions 108,110 of the other tying members 106A,106B. Of course, it is to be understood that these dimensions are simply used to illustrate the invention of the present application and that horizontal tying members of any size or combination of sizes could be utilized in the present invention to accommodate various post, shelf and superstructure sizes.

The tying members 106 comprise discrete members which each extend between two vertical support posts 104. The horizontal tying members 106 are sized in diameter to be received within openings 114 of the hollow vertical support posts 104 and in length to extend to approximately the center of the vertical support posts 104 (see FIGS. 4 and 5). The horizontal tying members 106 are then interlocked to the vertical support posts 104 by the pin and wedge arrangement of the present invention.

Figure 4:
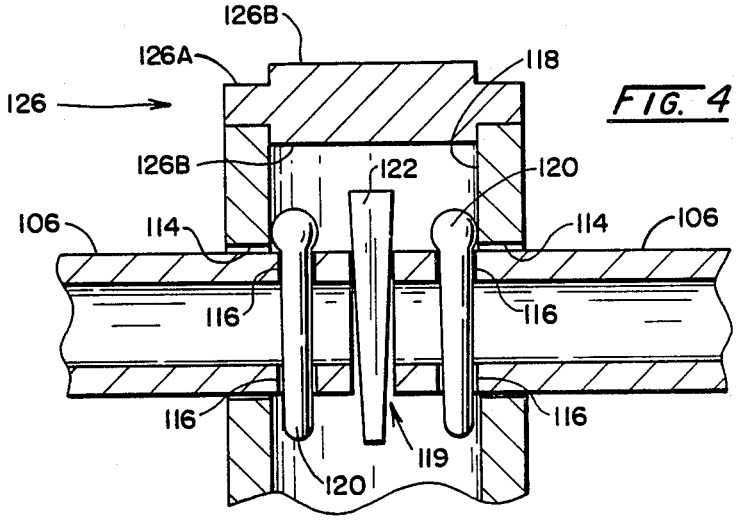

FIG. 4 shows two horizontal tying members 106 which extend to approximately the center of the hollow interior of an associated post 104. Apertures 116 are formed through the horizontal tying members 106 and are positioned near the ends of those members 106. The apertures 116 are positioned such that when the members 106 are inserted into the openings 114 of the vertical support posts 104 to form the superstructure 100, the apertures 116 are substantially adjacent to the interior wall 118 of the hollow interior of the vertical support posts 104 and a small gap 119 extends between the ends of the two members 106.

Locking pins 120 are inserted through the upper opening of the vertical support post 104 into the apertures 116 in the horizontal tying members 106. A wedge 122 is then inserted into the gap 119 between the two horizontal tying members 106. The wedge 122 tends to force the tying members 106 out of the vertical support post 104 such that the locking pins 120 engage the interior walls of the vertical support post 104 to thereby stably and rigidly interlock the horizontal tying members 106 to the vertical support post 104. It is noted that the locking pins 120 are preferably formed such that the interior wall 118 is engaged on both sides of the tying member 106.

Where a horizontal tying member 106 terminates in a perimeter vertical support post 104, there is no associated tying member 106 to which it can be coupled by means of the locking pin and wedge arrangement shown in FIG. 4. Accordingly, as shown in FIG. 5, an end lock 124 is inserted into the opening 114 in the exterior opening of the perimeter vertical support post 104 to provide the necessary terminating member to interlock the horizontal tying member 106 to the associated vertical support post 104.

The end lock 124 comprises a short stub of a horizontal member 106 and extends approximately from the center of the hollow interior of the vertical support post 104 to its exterior surface. The end lock 124 has apertures 125 formed therethrough to receive a locking pin 120 to prevent the end lock 124 from being forced out the opening in the vertical support post 104. Accordingly, a horizontal tying member 106 which terminates in a perimeter vertical support post 104 is interlocked to that post by means of an end lock 124, two locking pins 120 and an associated wedge 122, as shown in FIG. 5.

The kiln car superstructure 100 shown in FIGS. 1–3 is constructed using vertical posts 104 which each comprise four individual post sections 104A through 104D (see FIG. 2) which are coupled to one another by means of post couplers 126. While the posts 104 can be of substantially any geometry, the illustrated posts are circular in cross-section and hence the post section couplers 126 comprise a central disk 126A having reduced diameter disks 126B extending from either side of the disk 126A. The reduced diameter disks 126B correspond to the hollow interior of the post sections 104A through 104D (see FIGS. 4 and 5).

By utilizing post couplers 126 to couple individual post sections 104A through 104D to one another, kiln cap superstructures of any reasonably desired height can be constructed. It is noted that in FIGS. 1–3 the uppermost section 104D is inverted relative to the lower sections 104A through 104C such that the uppermost sections of shelves 112 form a cover for the kiln car superstructure 100. It is noted that this arrangement provides uneven shelf spacing, but permits a single size post section to be utilized for constructing a large variety of kiln superstructures.

If desirable, several post section sizes and configurations may be provided in the present invention to establish equalized spacing between the shelves and/or for other particular applications. One example where the bottom-most post sections 104A may be extended in length, as shown by the dotted line extensions 104AA to post sections 104A in FIG. 2, is to accommodate a kiln car 102 which has the center portion hollowed out to receive insulating fiber. Such modification of kiln cars is common since this reduces the amount of energy which must be applied to heat the kiln car superstructure and ceramic articles supported upon the superstructure for a kiln firing.

It is noted that lower post supports 127 may be formed the same as the post section couplers 126 provided wells or recesses are formed into the kiln car 102 to receive the lower extensions or reduced diameter disks 126B. Alternatively, the downwardly extending reduced diameter disks 126B can be eliminated from the couplers 126 to form the lower post supports 127.

While the tying members 106A determine the spacing between adjacent vertical support posts 104 to accommodate the shelves 112, the horizontal tying members 106B determine spacing between longitudinally adjacent shelves 112 such that circulation gaps 113 are maintained between adjacent shelves 112. Since the circulation gaps 113 run the length of the kiln car 102, these circulation gaps 113 are referred to as longitudinal circulation gaps.

Circulation gaps 130 are referred to as lateral circulation gaps since they run across the width of the kiln car 102 and are defined between laterally adjacent article supporting shelves 112. While the shelves 112 are stabilized by the loose fitting engagement of cutouts 132 with the posts 104, due to the loose fitting engagement, the shelves 112 may tend to shift and close the lateral circulation gaps 130. To maintain the lateral circulation gaps 130 opened and to further stabilize and rigidify the kiln car superstructure in accordance with the present invention, wedges 134 are inserted into the lateral circulation gaps 130. The wedges 134 force laterally adjacent shelves 112 apart and into the vertical supporting posts 104 at opposite ends of two article supporting shelves 112 or into other wedges 134 depending upon the configuration of the kiln car superstructure.

Wedges could, of course, also be inserted into the longitudinal circulation gaps 113 even though the longitudinal circulation gaps 113 are less likely to be closed by shifting of the shelves 112. If wedges are used in the longitudinal circulation gaps 113, the wedges are preferably inserted at the points 133 where four shelf sections come together. Insertion of wedges into the longitudinal circulation gaps 113 at the points 133 reduces the number of wedges required and may serve to further rigidify and stabilize the superstructure.

It is noted that enough dimensional variation may be provided between the cutouts 132 in the shelves 112 and the vertical supporting posts 104 such that the uppermost shelves 112 may be positioned upon the uppermost horizontal tying members 106C to reduce or eliminate the longitudinal circulation gaps 113 and the lateral circulation gaps 130. Such positioning of the uppermost shelf prevents debris from the crown of the kiln from falling onto articles supported on the superstructure as the kiln car 102 is positioned within or travels through a kiln.

As previously noted, the article supporting shelves 112 are preferably formed as two shelf sections 112A and 112B. Two shelf sections 112A and 112B are shown in FIG. 6 to illustrate in detail one embodiment of the shelves 112. As shown in FIG. 6, an overlapping joint 135 is formed between the two shelf sections 112A,112B. The overlapping joint 135 permits each shelf 112 to be formed as two sections 112A,112B which facilitates handling of the shelves for maintenance of the superstructure while maintaining the integrity of the shelf 112 to prevent dirt from falling to articles supported therebeneath.

The overlapping joint 135 comprises an upper lip or extension 136 which extends from the shelf section 112A. A lower lip or extension 138 extends from the shelf section 112B beneath the upper lip or extension 136. The upper edges 140 of the shelf sections 112A and 112B are beveled to reduce the possibility of articles or article carriers engaging the upper edges of the shelves 112 as they are slid into the super- structure 100 since adjacent shelves 112 may not be identical in height due to variations in formation or support.

For a simple overlapping joint, i.e., the upper and lower extensions 136,138 are approximately equal length, the lower edge 142 of the shelves 112 is also beveled such that the shelves can be reversed top for bottom in the kiln car superstructure 100 of the present invention. In the simple overlapping joint, the lower lip or extension 138 will catch and retain the majority of the dirt or dust generated by the engagement of the two shelf sections 112A,112B.

Alternatively, if dust or debris potentially generated by the contact of the shelf sections 112A, 112B is a serious concern, the sections 112A,112B might be formed as a single shelf 112 or the overlapping joint 135 can be formed to prevent any dust generated by contact of the two shelf sections 112A, 112B from falling onto articles supported therebelow. For this formation of the overlapping joint 135, the lower lip or extension 138 is formed slightly shorter than the upper lip or extension 136 such that the lower extension 138 does not contact the shelf section 112A and, hence, no dust can be generated thereby.

Similarly, the facing portions of the upper extension 136 and the lower extension 138 are formed such that they also do not contact one another. Accordingly, the only contact between the shelf sections 112A,112B is the end of the upper lip or extension 136 and the corresponding shoulder portion of the shelf section 112B and any dust generated by the contact is caught by the shelf-like upper surface 138A of the lower extension 138.

For this configuration of the shelves 112, the shelf sections 112A,112B cannot be reversed top for bottom since such reversal would defeat the dust trapping spacings just defined. Accordingly, the lower edges 142 of such shelves do not need to be beveled. Also shown in FIG. 6 are baffle retaining pins 144 which are inserted through apertures 146 formed in the shelf sections 112A,112B.

As shown in FIGS. 1 and 7, baffles 150 can be inserted along the sides of the superstructure 100 in accordance with the present invention. The use of such baffles diverts direct firing forces and associated debris from contacting articles supported within the kiln superstructure. The baffles 150 are retained by the vertical support posts 104 and the baffle retaining pins 144.

As previously noted, corresponding component parts of the kiln car superstructure are generally interchangeable with one another and can be used in various superstructures to conform to a given kiln car. Such interchangeability adds to the versatility of the superstructure and reduces required component inventories for the superstructure in accordance with the present invention.

The component parts, including the post sections, shelves, horizontal tying members, couplers, pins and wedges, are preferably formed from a ceramic material by extrusion and/or pressing. However, other forms of construction from metal or other materials having suitable strength and temperature characteristics may be more desirable for specific applications. It is also noted that the shelves and/or baffles may be formed having flat surfaces, ribbed surfaces or other patterned surfaces as may be preferred for a particular application.

While the locking pins for interlocking the horizontal members to the vertical support posts have a slightly different form from the baffle retaining pins in the illustrated embodiment of the present invention, each pin design includes an expanded head portion such that the pin may be inserted into a receiving hole but not fall therethrough. It is noted, however, that the particular design of the pins utilized in the present invention may vary, but preferably will include such an expanded head for retaining the pins in a desired location in the assembled superstructure.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A superstructure for a kiln car comprising:

hollow vertical support means for providing vertical support for said superstructure;

horizontal tying means extending into said hollow vertical support means for spacing said vertical support means to define said superstructure, selected ones of said tying means further providing generally horizontal supports for article receiving shelf means;

interlock means disposed within said hollow vertical support means for interlocking said horizontal tying means to said hollow vertical support means to thereby stabilize and rigidify said superstructure; and shelf means for receiving and supporting articles within said superstructure, said shelf means being supported upon said selected ones of said tying means and being formed to engage said vertical support means to stabilize said shelf means.

2. A superstructure for a kiln car as claimed in claim 1 wherein said horizontal tying means include gaps within said hollow vertical support means with apertures formed through said horizontal tying means on either side of said gaps, and said interlock means comprises locking pins inserted into said apertures and wedge means inserted into said gaps, said wedge means tending to enlarge said gaps and force said locking pins against the interior of said hollow vertical support means to thereby stabilize and rigidify said superstructure.

3. A superstructure for a kiln car as claimed in claim 2 wherein said hollow vertical support means comprise hollow vertical posts and post couplers having an outer geometric form the same as said vertical posts with projections on either side which correspond to the hollow interior geometry of said vertical posts whereby superstructures of varying heights can be constructed by coupling selected lengths of said vertical posts.

4. A superstructure for a kiln car as claimed in claim 3 wherein said horizontal tying means are hollow.

5. A superstructure for a kiln car as claimed in claim 4 wherein said shelf means have beveled upper edges whereby potential engagement of articles with the upper edges of said shelf means as such articles are slid thereacross is reduced.

6. A superstructure for a kiln car as claimed in claim 5 wherein said shelf means comprises a plurality of shelves each of which includes at least two sections having overlapping joints whereby said shelf means is more easily handled and yet dirt is prevented from falling onto ware supported beneath said shelves.

7. A superstructure for a kiln car as claimed in claim 5 wherein the lower edges of said shelf means are also beveled whereby said shelf means are reversible top for bottom in said superstructure.

8. A superstructure for a kiln car as claimed in claim 5 wherein said shelf means are sized relative to said tying means such that circulation gaps are formed between adjacent sections of said shelf means.

9. A superstructure for a kiln car as claimed in claim 8 further comprising wedge means inserted into selected ones of said circulation gaps for maintaining said selected circulation gaps and to further rigidify and stabilize said superstructure.

10. A superstructure for a kiln car as claimed in claim 9 further comprising baffle means and baffle retaining pins wherein said shelves include apertures for receiving said baffle retaining pins which in cooperation with said posts secure said baffle means to the sides of said superstructure.

11. A superstructure for a kiln car comprising:

a plurality of hollow vertical support posts, each of said posts including a plurality of openings which extend into the hollow interior thereof for receiving interconnecting horizontal members to form said superstructure;

a plurality of horizontal members extending between said vertical supports posts and sized to extend into said openings to approximately the center of the hollow interior of said vertical support posts;

interlock means disposed within said hollow vertical support posts for interlocking said horizontal members to said hollow vertical support posts to thereby stabilize and rigidify said superstructure yet permit disassembly for maintenance or repair; and article supporting shelves which are supported upon selected ones of said horizontal members whereby said article supporting shelves can support substantial amounts of ceramic articles to be fired while being made relatively thin and therefore lightweight, said article supporting shelves being formed to engage said vertical support posts for stabilizing said shelves.

12. A superstructure for a kiln car as claimed in claim 11 wherein said horizontal members include apertures formed therethrough, said apertures located substantially adjacent to the interior wall of said vertical support posts when said horizontal members are inserted into said openings to form said superstructure, and said interlock means comprises locking pins inserted into said apertures and including retention means for retaining said pins within said apertures and wedge means inserted between adjacent ends of said horizontal members, said wedge means tending to force associated horizontal members apart and thereby engage said locking pins against the interior of said hollow vertical support posts to thereby stabilize and rigidify said superstructure.

13. A superstructure for a kiln car as claimed in claim 12 wherein said horizontal members include end lock members for terminating runs of horizontal members at the perimeter of said superstructure, said end lock members being sized to extend approximately from the center of the hollow interior of a perimeter vertical support post to the exterior edge of said perimeter vertical support post whereby runs of horizontal members are terminated at the outer surface of perimeter vertical support posts and are also secured thereto by said interlock means.

14. A superstructure for a kiln car as claimed in claim 13 wherein said hollow vertical support posts comprise at least two hollow post sections interconnected by post couplers which have an outer geometric form the same as said post sections with projections on either side which correspond to the hollow interior geometry of said post sections whereby superstructures of varying heights can be constructed by coupling selected lengths of said post sections to one another.

15. A superstructure for a kiln car as claimed in claim 14 wherein said horizontal members are hollow.

16. A superstructure for a kiln car as claimed in claim 15 wherein said article supporting shelves have upper and lower edges beveled whereby potential engagement of articles with the upper edges of said shelves as such articles are slid thereacross is reduced and said shelves are reversible top for bottom in said superstructure.

17. A superstructure for a kiln car as claimed in claim 16 wherein said article supporting shelves comprise at least two sections having overlapping joints to form an article supporting shelf whereby dirt falling onto ware supported therebeneath is reduced.

18. A superstructure for a kiln car as claimed in claim 17 wherein said article supporting shelves are sized relative to said horizontal members such that circulation gaps are formed between adjacent shelves.

19. A superstructure for a kiln car as claimed in claim 18 further comprising wedge means inserted into selected ones of said circulation gaps for maintaining said selected gaps and to further rigidify and stabilize said superstructure.

20. A superstructure for a kiln car as claimed in claim 19 further comprising baffle means and baffle retaining pins wherein said shelves include apertures for receiving said baffle retaining pins which in cooperation with said posts secure said baffle means to the sides of said superstructure.

* * * * *